United States Patent [19]

Holt

[11] Patent Number: 5,064,190

[45] Date of Patent: Nov. 12, 1991

[54] CROSS-COUNTRY SKIING AND EXERCISING MACHINE

[76] Inventor: Peter P. Holt, 2104 Centennial Dr., St. Cloud, Minn. 56301

[21] Appl. No.: 484,103

[22] Filed: Feb. 23, 1990

[51] Int. Cl.[5] ..... A63B 69/18

[52] U.S. Cl. ..... 272/97; 272/70

[58] Field of Search ..... 272/97, 134, 132, 69, 272/97, 93, 70.3, 70

[56] References Cited

U.S. PATENT DOCUMENTS

| | | | |
|---|---|---|---|
| 1,982,843 | 11/1934 | Traver | 272/70 |
| 4,135,535 | 1/1979 | Thomas | 272/70.3 |
| 4,402,506 | 9/1983 | Jones | 272/97 |
| 4,538,807 | 9/1985 | Rice | 272/146 |
| 4,645,201 | 2/1987 | Evans | 272/70 |
| 4,664,373 | 5/1987 | Hait | 272/117 |

FOREIGN PATENT DOCUMENTS

| | | | |
|---|---|---|---|
| 2147212 | 5/1985 | United Kingdom | 272/93 |

OTHER PUBLICATIONS

Weight Walker 21 Minute Work Out, Peter Holt, 1986.
"The Health Maker 'A Complete, Natural Exerciser'", 8-page Brochure of Equipment Builders Inc.
"Nordic Track Brings the World's Best Fitness Into Your Home: Our New Achiever Model", 16 page Brochure.
"At Last . . . Total Fitness Made Easier by the Healthmaker Exercise and Progrqm", 6-page Brochure of American Fitness Products, Inc.
"Weight Walker 21 Minute Workout", One-Page Brochure.
"Fitness Master LT-35" advertisement from Western's World Magazine, Jul. 1985, p. 66.
"The Fitness Master XC-1" four-page Brochure.

*Primary Examiner*—Richard J. Apley
*Assistant Examiner*—J. Donnolly
*Attorney, Agent, or Firm*—Palmatier & Sjoquist

[57] ABSTRACT

The present cross-country skiing and exercising machine includes a stand and a skiing platform slidable into and out of the stand. The platform includes channeled tracks on which ride skates with rollers. The tracks are carpeted to provide resistance to the rollers with a minimum of noise. Free dead weights are mountable on the skates to increase the workout effort. Heavy metal poles are provided and include distal ends which cooperate with sockets disposed on either side of the stand. The poles include means for receiving free dead weights so as to further increase the effort required. The poles are manipulatable parallel and transversely of the tracks and in a 360° arc to provide a variety of exercise motions.

18 Claims, 5 Drawing Sheets

CROSS-COUNTRY SKIING AND EXERCISING MACHINE

The present invention relates to exercising machines and, more particularly, to exercising machines that simulate cross-country skiing.

BACKGROUND OF THE INVENTION

Machines that attempt to simulate the motion of cross-country skiing typically include complex cable, pulley, and tensioning arrangements. Such machines may cause considerable noise and require frequent maintenance. Furthermore, these machines tend to be excessively heavy and occupy too much space for residential use.

SUMMARY OF THE INVENTION

A feature of the present invention is the provision in a cross-country skiing and exercising machine having an elongate skiing platform with tracks in which skates ride, of a locating means for locating and receiving the distal ends of ski poles and being disposed on both sides of the platform whereby the poles are manipulatable parallel to and transversely of the tracks and in a 360° arc about the locating means.

Another feature is the provision in such a cross-country skiing and exercising machine, of support boards which extend from a lower portion of a stand and include sockets for locating and receiving the distal ends of the ski poles, and wherein the distal ends are freely removable from the sockets.

Another feature is the provision in such a cross-country skiing and exercising machine, of safety sockets which confine the distal ends of the ski poles to prevent the poles from being dropped yet allowing a free range of motion parallel and transversely to the tracks and in a 360° arc about the sockets.

Another feature is the provision in such a cross-country skiing and exercising machine, of weight increasing means including dead weight disks being mountable on the handles of the ski poles to increase the required effort of a workout.

Another feature is the provision in such a cross-country skiing and exercising machine, of a ski pole formed of a solid metal rod.

Another feature is the provision in such a cross-country skiing and exercising machine, of carpeted tracks to provide resistance to the rollers of the skates with a minimum of noise.

Another feature is the provision in such a cross-country skiing and exercising machine, of weight increasing means including dead weight disks mountable on the skates to increase the workout load.

An advantage of the present invention is that it is quiet in operation.

Another advantage is that it occupies a minimum amount of space.

Another advantage is that it is suited for use by beginners or the blind as it includes hand supports.

Another advantage is that the load on the skates may be increased simply and quickly to provide a workout requiring greater effort.

Another advantage is that the load on the ski poles may be increased or adjusted simply and quickly to vary the exertion required.

Another advantage is that it is safe. The ski poles are lockable to the stand for storage, and, in one embodiment, are confined to an upright yet swingable, operating position.

Another advantage is that it accommodates skiers of different heights as the ski poles are adjustable in length and the skiing platform is slidably positionable relative to the sockets of the stand.

DETAIL DESCRIPTION OF THE PREFERRED EMBODIMENTS

Figure 1:
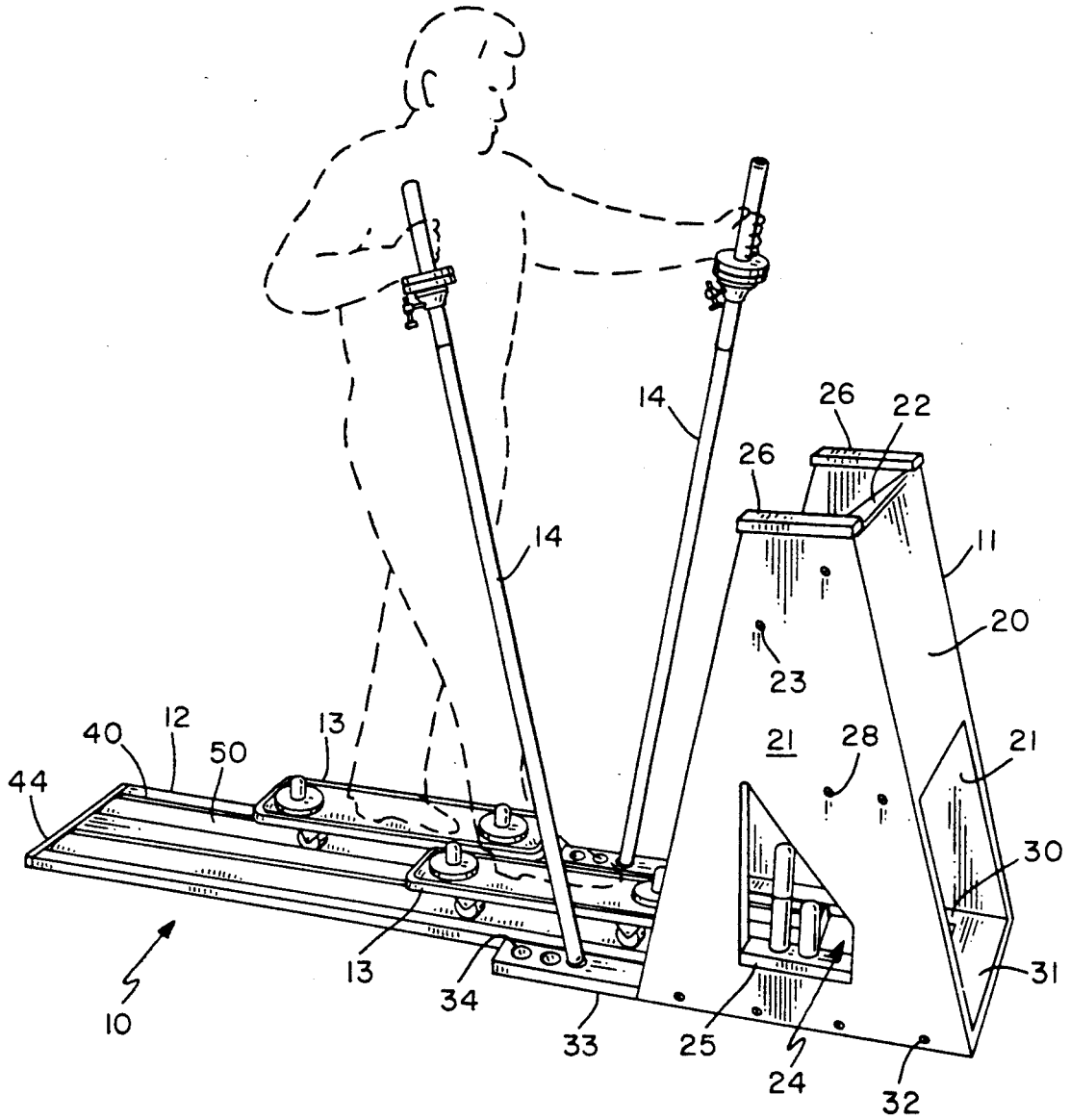
FIG. 1 shows perspective view of the cross-country skiing and exercising machine in operation.
Figures 2, 3, 4, 10:
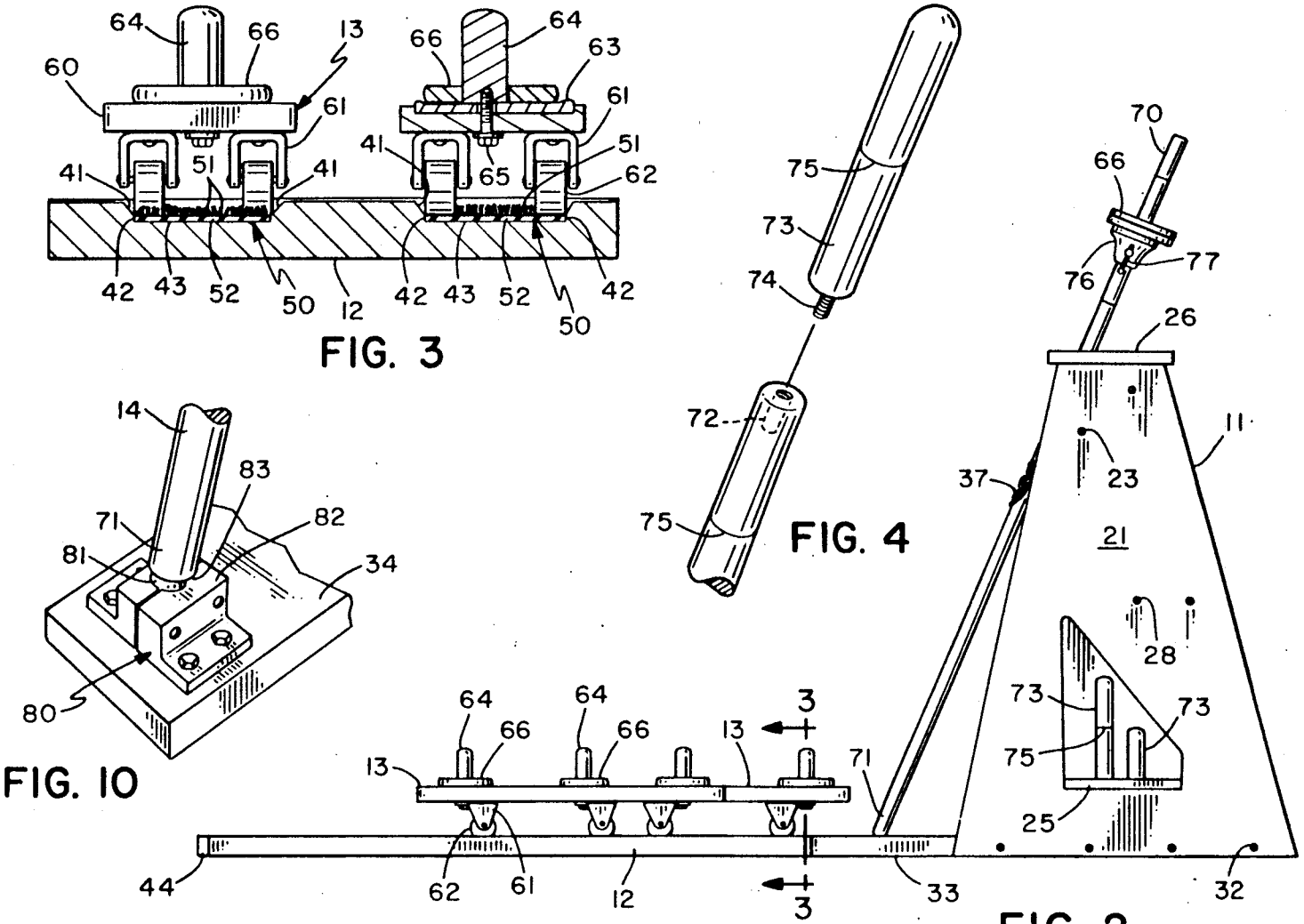
FIG. 2 is a side elevation view of one side of the machine of FIG. 1.
FIG. 3 is a section view at lines 3—3 of FIG. 2.
FIG. 4 is a partial view of one of the poles of the machine of FIG. 1.
FIG. 10 is a partial view of a ball joint of one of the ski poles mounted in a safety socket.
Figures 5, 11, 12:
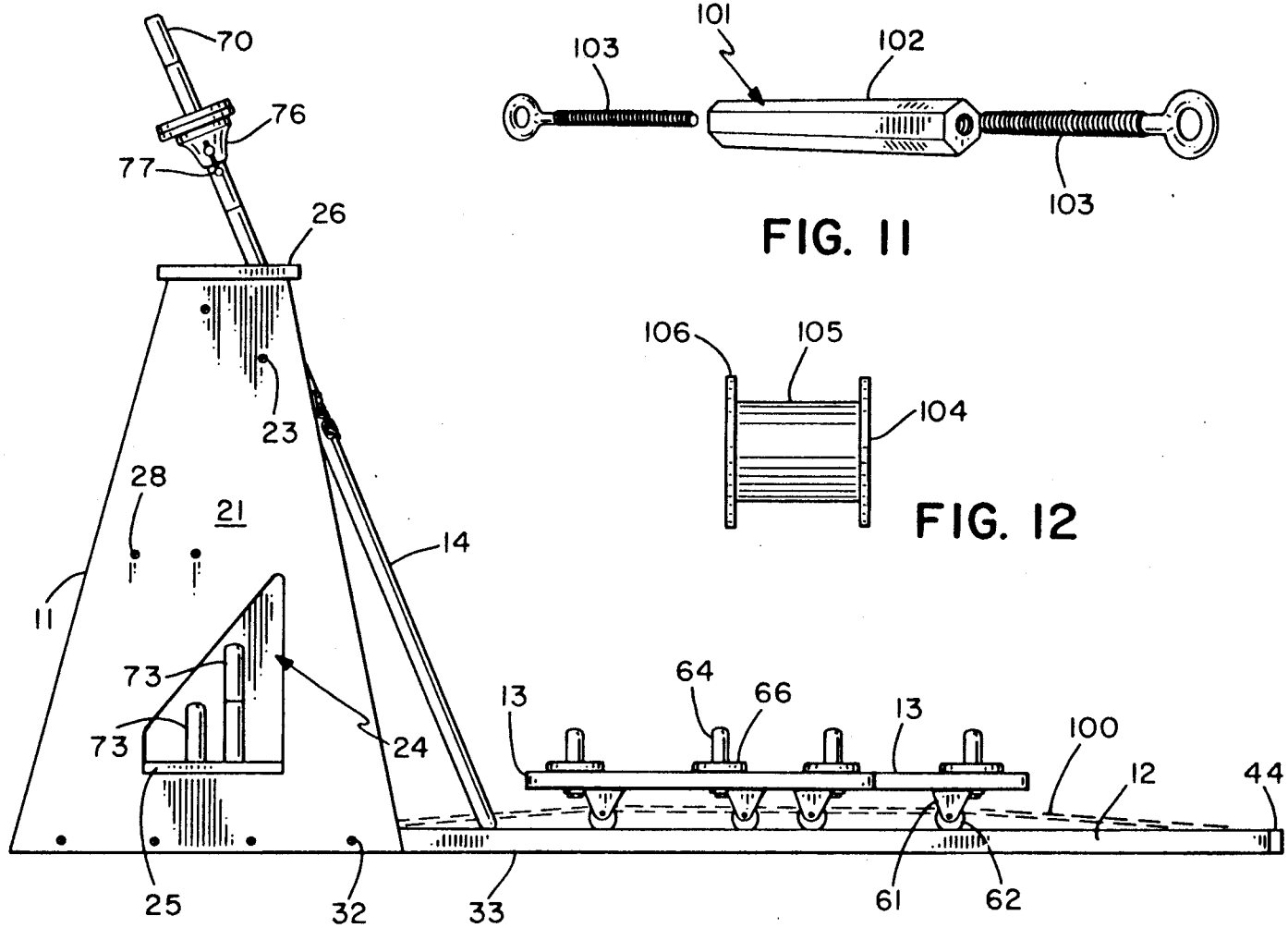
FIG. 5 is a side elevation view of the other side of the machine relative to the view illustrated in FIG. 2.
FIG. 11 is a view of a turn buckle for the embodiment shown in FIG. 5.
FIG. 12 is an end view of a roller utilized in the embodiment shown in FIG. 5.
Figure 6:
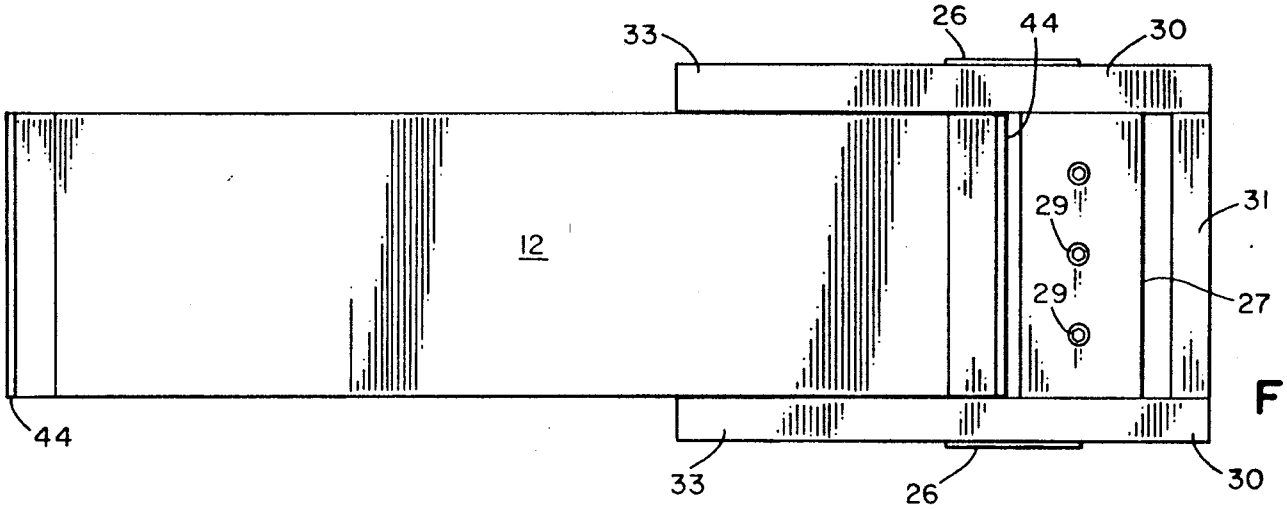
FIG. 6 is a bottom plan view of the machine of FIG. 1.
Figure 7:
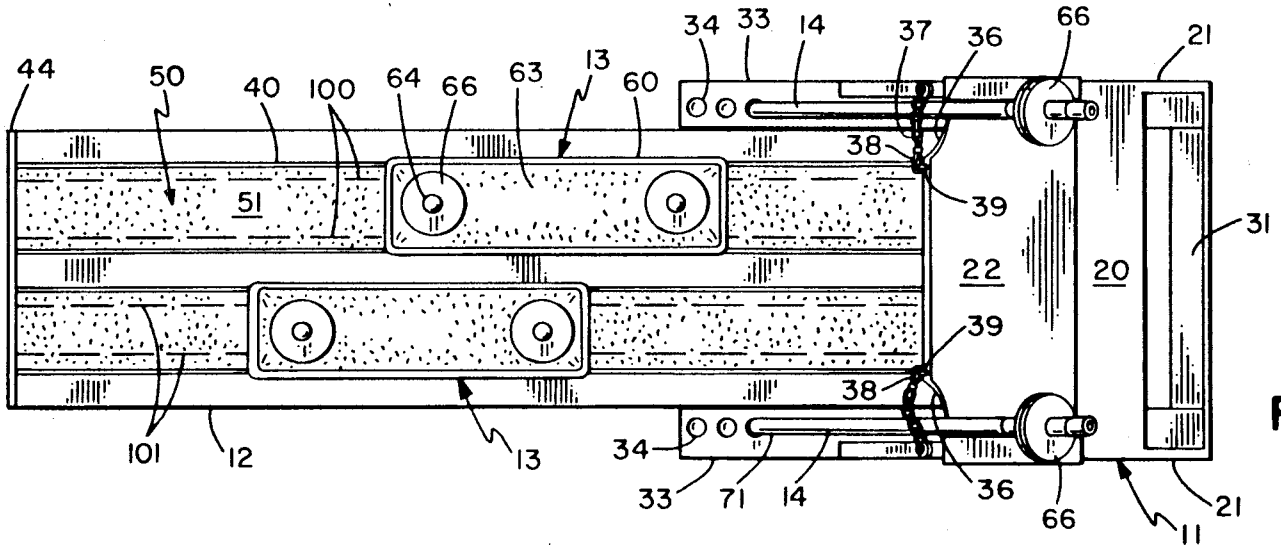
FIG. 7 is a top plan view of the machine of FIG. 1.
Figure 9:
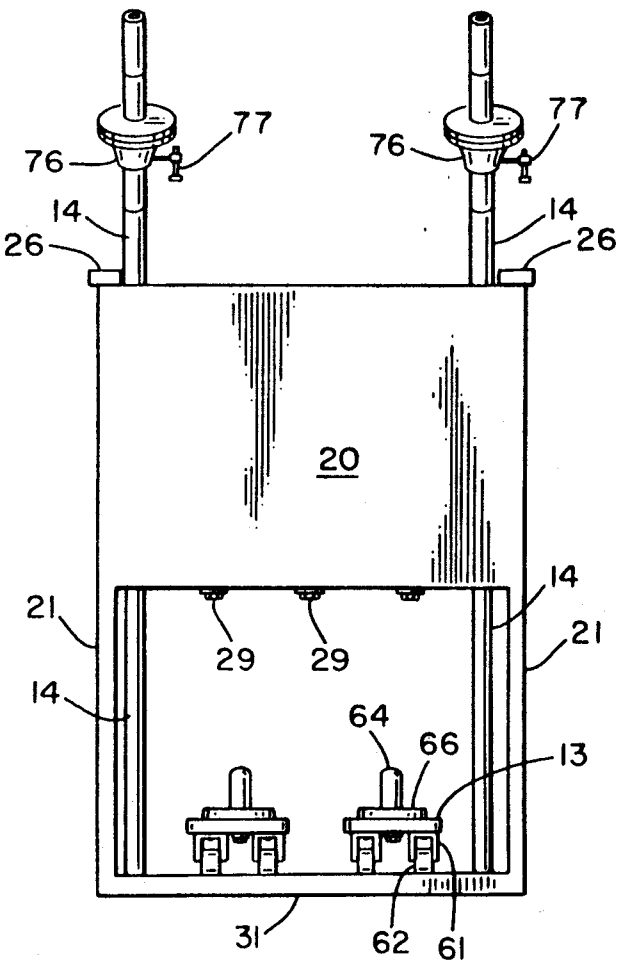
FIG. 9 is a front elevation view of the machine of FIG. 1.
Figure 8:
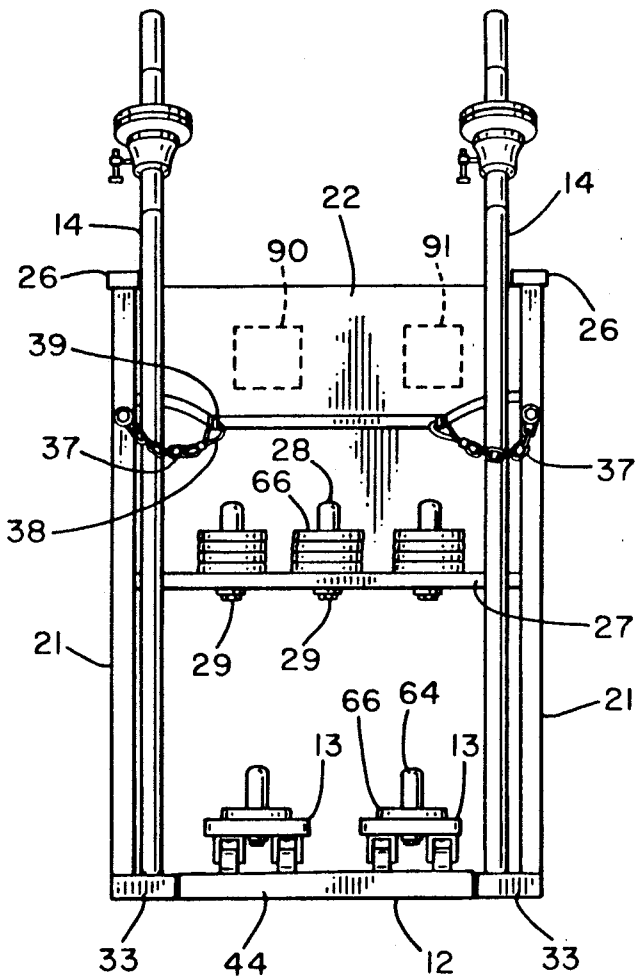
FIG. 8 is a rear elevation view of the machine of FIG. 1.

As shown in FIG. 1, the cross-country skiing and exercising machine is indicated in general by the reference numeral 10. Its principal components include a stand 11, a skiing platform 12, skates 13, and poles 14.

The stand 11 includes a front, oblique, generally rectangular, wooden panel 20, a pair of side, generally trapezoidal wooden panels 21, and a rear oblique, generally rectangular, wooden panel 22. The rear panel 22 is joined to and between the side panels 21 by a set of screws 23. Each of the side panels 21 includes a trapezoidal opening 24 formed in part by an apertured strip of hardwood 25 affixed to its respective side panel 21. Wooden hand supports 26 are affixed to the upper edges of each of the side panels 21.

The stand 11 further includes a weight storage shelf 27 joined to and between the side panels 21 via a set of screws 28. The shelf 27 includes a set of three dead weight disk receiving pegs 28. Each of the pegs 28 is affixed to the shelf 27 via a pin connector 29.

The stand 11 further includes side, wooden boards or supports 30 and a front, wooden board or support 31. The supports 30, 31 are disposed in a generally U-shaped form. The side boards 30 are joined to bottom portions of the side panels 21 by a set of screws 32. Each of the side boards 30 includes a shoe 33 extending rearwardly from the stand 11. Each of the shoes 33 includes a set of three spaced apart, pole-receiving sockets 34 formed linearly and medially therein.

Stand 11 also includes a pair of pole-receiving curved recesses 36 formed in the bottom portion of the rear oblique panel 22. A removable chain 37 is affixed to an edge portion of each of the side panels 21 and extends across its respective curved recess 36 where it is clipped via a clip 38 to an eyelet 39 secured to a bottom rear edge of the rear panel 22.

The skiing platform 12 includes a pair of tracks 40 channeled lengthwise therein. Each of the tracks 40 is formed by a pair of bevelled edges 41, a pair of vertical edges 42 extending downwardly from the beveled edges 40, and a horizontal floor 43. An abutment strip 44 formed of a hardened wood is affixed to either end of the platform 12 to serve as stops or skate abutments.

Each of the tracks 40 includes an elongate carpet section 50. Each of the carpet sections 50 includes fibrous strands 51 affixed to a backing 52. Each of the carpet backings 52 is secured to its respective floor 43.

The carpet section 50 is a Mohawk Saxony Scotch Guard short cut pile carpet or short plush carpet with the following specifications:

Construction: cut pile
Yarn: 100% nylon
Yarn weight per square yard: 51 ounces
Stitch gauge (height of yarn): ⅜ inch
Backing: polypropylene The resistance of the carpet section 50 may be varied by varying the yarn weight per square yard or the stitch gauge. For instance, the resistance is decreased by utilizing carpet with a yarn weight per square yard of less than 51 ounces such as 28 ounces, which is typically utilized for settings such as schools or commercial establishments. Resistance is also decreased by utilizing a shorter stitch gauge such as ⅛, which is typically found in schools and commercial establishments. Conversely, resistance is increased by increasing the yarn weight per square yard or the stitch gauge.

The width of the platform 12 is substantially equal to or substantially less than the distance between the inner edges of the shoes 33 and boards 30. The platform 12 is slidable into and out of the stand 11 between the boards 30. The front end 44 of the platform 12 is bearable against the rear edge of the front board 31 when the platform 12 is slid fully into the stand 11 so that the machine 10 occupies a minimum amount of space.

Each of the skates 13 includes a wooden base 60 with a set of four brackets 61 affixed to its lower face. Each of the brackets 61 mounts a roller or wheel 62. A carpet section 63 with a backing and fibrous strands is secured to the upper face of each of the bases 60 of each of the skates 13. A peg 64 is secured by a pin connector 65 to each of the ends of the skates 13. The peg 64 typically receives an apertured, 1¼ pound, dead weight disk 66. A layer of 4–5 disks may be placed on each peg 64. The carpet section 63 includes the specifications of carpet section 50.

Each of the poles 14 is a solid steel, chrome-plated rod with a handle end 70 and a rounded distal end 71 for cooperating with one of the sockets 34. Each of the handle ends 70 and each of the distal ends 71 includes a threaded bore 72 formed therein. Pole extensions 73 are provided and include a threaded pin connector 74 for cooperating with one of the bores 72. Each of the handle ends 70 and some of the pole extensions 73 include scores 75 for orienting the 1¼ pound aperture, dead weight disks 66 which may be disposed on the handle end 70. The disks 66 are oriented and held by weight holders 76 which include pin tighteners 77 for holding the weight holders 76 relative to the poles 14.

In operation, the platform 12 is first slid partially out of the stand 11 to a desired position relative to the sockets 34. Subsequently, the desired number of dead weight disks 66 are placed on the skates 13. The weight holders 76 are positioned at a prescribed height and the desired number of dead weight disks 66 are slid onto the handle end 70. After the chains 37 are released, the operator grasps the poles 14 and steps onto the skates 14.

During the simulation of cross-country skiing, the poles 14 may be manipulated in planes running substantially parallel to the planes in which the legs of the operator and the skates 13 move. Moreover, the poles 14 may be manipulated in a cross over motion in front of the operator's body and transverse to each other. Still further, the handle ends 70 of the poles 14 may be manipulated in a circular motion to draw imaginary cone-shaped figures with the point of the imaginary cone being disposed in the socket 34. A small amount of petroleum jelly may be applied to the socket 34 to minimize wear on the socket 34 by the distal end 71 of the pole 14.

As the skates 13 slide back and forth over the carpet sectiosn 50, the carpet sections 60 provide resistance to the roller 62 of the skates 13. Noise is minimized as the roller 62, which bear against and create depressions in the fibrous tands 51, cause little of the grinding commonly found in cable and pulley arrangements. Edge portions of the rollers 62 bear at times against the beveled edges 41 to maintain the skates 13 in the tracks 40, but the main weight of the operator is brought to bear on the carpeted sections 50. Abutment ends 44 serve to stop the skates 13 from running off of the platform 12.

If desired, the hand supports 26, instead of the poles 14, may be grasped to lend support. The hand supports 26 typically are utilized for beginners or the blind.

In an alternate embodiment of the invention, the safety socket 80 includes a ball joint 81 threaded onto the dista end 71 of one of the poles 14. The socket 80 includes an upper planar surface 82 and the distal end 71 includes a lower circular edge 83. The lower circular edge 83 bears against the upper surface 82 when the pole 13 is dropped to approximately a 30° angle relative the upper surface 82 and the shoe 34 so as to prevent the steel pole 14 from dropping to the floor. The sockets 80 allow parallel and transverse movement of the pole 14 relative the tracks 40, and also permit the drawing of imaginary cone-shaped figures by moving the handle end 70 in circular motion.

It should be noted that the rear oblique panel 22 may include performance indicators such as a timer 90 or a pulse indicator 91 to measure heart rate.

In an alternate embodiment of the invention, a pair of nylon belts 100 cooperates with each of the skates 13. The front end of each of the belts 100 is affixed to the front end 44 of the platform 12. Each of the rear ends of each of the belts 100 extends from a turn buckle 101, to a skate 13, to the front end 44 of the platform 13. The belt 100 may be formed of leather, or may be a rope or a steel cable, although a steel cable is typically more noisy than a nylon, leather or rope belt.

The turn buckle 101 is utilized for tightening or loosening the belt 100 so as to increase or decrease resistance or drag of the skates 13. The turn buckle 101 includes an elongate block 102 with a central threaded hole for securing threaded connector pins or bolts 103. One of the bolts 103 is connected to rear end 44 of the platform 13 and the other bolt 103 is connected to the rear end of the belt 100.

Each of the skates 13 of this embodiment includes a set of front rollers 104 with a continuous bight 105 for receiving the strap 100. The bight 105 maintains the strap 100 on the roller 104. The bight 105 and an outer wheel surface 106 may bear against the carpet section 50.

In operation, the block 102 of the turn buckle or tightening means 101 is turned to increase or decrease the effective length of the belt 100 to adjust the belt 100 to a predetermined tension. Subsequently, an operator exercises on the machine 10 by simulating a skiing motion on the skates 13. As the skates 13 roll back and forth, both the belt 100 and the carpet section 50 cooperate to create resistance for the skates 13. The belt 100 brings pressure to bear on the rollers 104 which in turn brings pressure to bear on the carpet section 50. It is contemplated that this embodiment may be advantageously utilized in unsupervised hotels or motels where theft is likely, especially theft of unattached parts such as the skates 13 and dead weights 66. The safety socket 80 may also be utilized in these locations.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A cross country skiing and exercising machine comprising:

an elongate skiing platform with a pair of tracks channelled lengthwise therein, each of the tracks comprising a fibrous carpet, a pair of skates ridable in the tracks, each of the skates including an upper, foot-supporting surface, each of the skates including means for receiving an apertured dead weight disk for increasing the mass of each of the skates, each of the skates further comprising a roller for rolling on the carpet of each of the tracks, the carpet of the tracks providing resistance to the rollers with a minimum of noise, a pair of relatively heavy poles for simulating cross-country skiing, each of the poles including a handle and a distal end, each of the poles being a solid metal rod from the handle to the distal end, each of the handles comprising means for receivign an apertured, dead weight disk for further increasing the mass of each of the poles, locating means for locating and freely receiving the distal end of each of the poles and disposable on both sides of the platform such that each of the poles is manipulatable parallel to and transversely of the tracks and readily and freely insertable in and removable from teh locating means, and a stand with upper and lower portions, the platform being disposable within the stand, and the locating means being affixed to the stand.

2. The cross-country skiing machine of claim 1, and further comprising a stand with upper and lower portions, the platform being disposable within the stand.

3. The cross-country skiing machine of claim 2, wherien the platform is slidable into and out of the stand.

4. The cross-country skiing machine of claim 1, wherein the means for receiving the distal ends of each of the poles includes a pair of boards, each of the boards having a socket for locating and receiving one of the distal ends.

5. The exercising machine of claim 4, wherein each of the boards includes safety means for maintaining each of the poles in an upright position.

6. The exercising machine of claim 5 and wherein each of the distal ends of each of the poles includes a lower edge, and each of the safety means includes a ball joint affixed to each of the poles and mounted in a bearing affixed to one of the boards, each of the safety means having an upper surface, each of the lower edges of the distal ends being bearable against its respective upper surface of the safety means whereby the poles are prevented from falling to the floor.

7. The exercisign machinea ccording to claim 1, wherein the dead weight disk receiving means is mountable on the handle of each of the poles at different heights.

8. The exercisign machine of claim 1, and further comprising a pole extension with a threaded axial pin connector, and wherein each of the poles includes a threaded axial bore formed in both its handle and its distal end, the pin connector being threadable into either of the bores to extend pole length.

9. The exercising machine of claim 4, wherein each board is elongate and includes three sockets spaced apart lengthwise of each other.

10. The exercising machine of claim 1, wherein each of the dead weight disk receiving means includes a peg affixed to one of the skates, and at least one apertured, dead weight disk insertable onto the peg.

11. The exercising machine of claim 1, wherein each of the upper foot-supporting surfaces of each of the skates comprises a fibrous carpet.

12. A cross country skiing and exercising machine comprising:

an elongate skiing platform with a pair of tracks channelled lengthwise therein, a pair of skates ridable in the tracks, each of the skates including an upper, foot-supporting surface, a pair of poles for simulating cross-country skiing, each of the poles including a handle and a distal end, locating means for locating and receiving the distal end of each of the poles and disposable on both sides of the platform such that each of the poles is manipulatable parallel to and transversely of the tracks, and a stand with upper and lower portions, the platform being disposable within the stand, the stand comprising a front portion, the front portion including a pair of curved recesses, each of the recesses receiving a portion of one of the poles whereby the poles are maintained in an upright position for storage, the front portion also including a pair of locks, each of the locks extending across one of the recesses for locking its respective pole in its respective recess.

13. A cross country skiing and exercising machine comprising:

an elongate skiing platform with a pair of tracks formed lengthwise therein, a pair of skates ridable in the tracks, each of the skates including an upper, foot-supporting surface, each of the skates including means for receiving an apertured dead weight disk for increasing the mass of each of the skates, a pair of poles for simulating cross-country skiing, each of the poles including a handle and a distal end, locating means for locating and receiving the distal end of each of the poles and disposable on both sides of the platform such that each of the poles is manipulatable parallel to and transversely of the tracks, and a stand with upper and lower portions, the platform being disposable within the stand, the stand comprising an oblique panel for mounting performance indicators.

14. The cross-country skiing machine of claim 2, wherein the stand includes a pair of hand support bars mounted transversely of each other on the upper portion of the stand.

15. A cross country skiing and exercising machine comprising:

an elongate skiing platform with a pair of tracks formed lengthwise therein, a pair of skates ridable in the tracks, each of the skates including an upper, foot-supporting surface, each of the skates including means for receiving an apertured dead weight disk for increasing the mass of each of the skates, a pair of poles for simulating cross-country skiing, each of the poles including a handle and a distal end, locating means for locating and receiving the distal end of each of the poles and disposable on both sides of the platform such that each of the poles is manipulatable parallel to and transversely of the tracks, and a stand with upper and lower portions, the platform being disposable within the stand, the locating means being affixed to the stand.

16. A cross country skiing and exercising machine comprising:

an elongate skiing platform with a pair of tracks formed lengthwise therein, the platform comprising two ends with a pair of belts affixed to and between the ends, a pair of skates ridable in the tracks, each of the skates including an upper, foot-supporting surface, each of the skates furthe comprising a roller for riding on one of the tracks, each of the belts running over one of the rollers to increase resistance of the skates, a pair of poles for simulating cross-country skiing, each of the poles including a handle and a distal end, and locating means for locating and receiving the distal end of each of the poles and disposable on both sides of the platform such that each of the poles is manipulatable parallel to and transversely of the tracks.

17. The cross-country skiing machine of claim 16 wherein the belt includes a tightening means for varying the effective length of the belt so as to vary resistance of the skates.

18. A cross-country skiing and exercising machine comprising:

(a) a stand which comprises:

(1) front, side and rear panels, the rear panel being oblique for mounting performance indicators, (2) a shelf extending between the side panels with pegs for storing dead weights, (3) a pair of shoes extending rearwardly from the side panels, each of the shoes including a set of at least three sockets spaced apart lengthwise from each other, (4) a pair of hand supports mounted on the side panels, and (5) a pair of pole receiving curved recesses formed in the front panel and a removable lock extending across the recess, (b) an elongate skiing platform with two sides and two ends and being slidable into and out of the stand between the shoes, the platform including two tracks charnelled therein, each of the tracks being carpeted, each of the ends having raised abutments for serving as skate stops, each of the tracks being formed in part by a pair of beveled edges, (c) a pair of skates ridable in the tracks, each of the skates including an upper, carpeted, foot-supporting surface and rollers, each of the skates also including a pair of pegs for receiving apertured, dead weight disks for increasing skate weight, the rolles riding on the carpeted tracks between the beveled edges such that the carpet provides a resistance for the rollers with a minimum of noise, and (d) a pair of poles for simulating cross-country skiing, each of the poles including a handle and a distal end, each of the poles being a solid metal rod, each fo the handles including means for receiving apertured, dead weight disks, a portion of each of the poles being receivable in the curved recesses and lockable therein by the locks, each of the distal ends being receivable in and freely removable from its respective socket such that each of the poles is manipulatable parallel to and transversely of the tracks whereby cross-country skiing is simulated.

* * * * *